US009828756B2

(12) United States Patent
Defu et al.

(10) Patent No.: US 9,828,756 B2
(45) Date of Patent: Nov. 28, 2017

(54) CONTROLLABLE SELF-CLEANING DEVICE FOR A FLUSHING SPRAY NOZZLE

(71) Applicant: WDI (Xiamen) Technology Inc., Xiamen (CN)

(72) Inventors: Chen Defu, Xiamen (CN); Zhang Wei, Xiamen (CN); Li Zhaoxi, Xiamen (CN)

(73) Assignee: WDI (Xiamen) Technology Inc., Xiamen (CN)

( * ) Notice: Subject to any disclaimer, the term of this patent is extended or adjusted under 35 U.S.C. 154(b) by 239 days.

(21) Appl. No.: 14/721,842

(22) Filed: May 26, 2015

(65) Prior Publication Data

US 2016/0017586 A1 Jan. 21, 2016

(30) Foreign Application Priority Data

May 27, 2014 (CN) ..... 201420276114

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.4, 420.5, 444, 447, 448
See application file for complete search history.

(56) References Cited

U.S. PATENT DOCUMENTS 4,841,582 A * 6/1989 Matsui ..... E03D 9/08 4/448
8,296,872 B2 * 10/2012 Yao ..... E03D 9/08 4/448
2008/0201836 A1 * 8/2008 Yao ..... E03D 9/08 4/420.4

* cited by examiner

*Primary Examiner* — Tuan N Nguyen
(74) *Attorney, Agent, or Firm* — Ralph E. Jocke; Walker & Jocke

(57) ABSTRACT

A controllable self-cleaning device for a flushing spray nozzle is provided and includes a self-cleaning pole and a manual control valve. The self-cleaning pole is disposed with an inlet and a flushing hole to clean the flushing spray nozzle. The inlet is connected to the flushing hole. The manual control valve is disposed with an inlet port to connect to the water source and a self-cleaning outlet port. The self-cleaning outlet port of the manual control valve is connected to the inlet of the self-cleaning pole. With the above structure, the outflow of the flushing hole of the self-cleaning pole by the manual control valve is manually controllable, so that the user can control the clean time of the self-cleaning pole manually. For a single cool cover, the controllable self-cleaning device includes the self-cleaning pole to clean the flushing spray nozzle.

12 Claims, 7 Drawing Sheets

CONTROLLABLE SELF-CLEANING DEVICE FOR A FLUSHING SPRAY NOZZLE

CROSS-REFERENCE TO RELATED APPLICATIONS

This application claims priority to Chinese Patent Application No. 201420276114.4, filed May 27, 2014, which has publication number CN 203899824 U, the disclosure of which is incorporated herein by reference in its entirety.

TECHNICAL FIELD

The present application relates to a cleaning mechanism, especially to a controllable self-cleaning device for a flushing spray nozzle.

BACKGROUND

There are two kinds of flushing toilet covers. One is an electronic and intelligent cover. The other one is single cool cover. Two kinds of covers are configured basically with one or two nozzles to wash the privates. The electronic and intelligent cover is applied with electric power to drive the self-cleaning waterway to flush water out of the nozzle. The unplugged single cool cover is applied with a spray pole that can extend out and withdraw back to leak water to clean the spray nozzle. However, both kinds of cleaning methods have disadvantages. The wash time of the spray nozzle is short, so that it cannot guarantee the clean effect of the spray nozzle. As the electric and intelligent cover flushes by the electric power, when the spray pole totally extends out, it stops flushing. The single cool cover, depending on the leakage of the spray pole to wash the spray nozzle, stops flushing when the spray pole totally extends out.

SUMMARY

The object of an exemplary embodiment of the present application is to overcome the disadvantages of the existing technology by providing a controllable self-cleaning device for a flushing spray nozzle that is manually controlled, so that the cleaning time may be adjusted manually to enhance the cleaning effect.

One aspect of an exemplary embodiment is directed to a controllable self-cleaning device for a flushing spray nozzle. The controllable self-cleaning device includes a self-cleaning pole and a manual control valve. The self-cleaning pole is disposed with an inlet and a flushing hole to clean the flushing spray nozzle. The inlet is connected to the flushing hole. The manual control valve is disposed with an inlet port to connect to the water source and a self-cleaning outlet port. The self-cleaning outlet port of the manual control valve is connected to the inlet of the self-cleaning pole.

In another aspect of the exemplary embodiment, the manual control valve further includes a flushing outlet port. The flushing outlet port is connected to the inlet port of the flushing spray nozzle. The flushing outlet port of the manual control valve and the self-cleaning outlet port are switched to outflow water.

In another aspect of the exemplary embodiment, the manual control valve includes a rotating handle, a moving valve disc, a static valve disc, a valve body and a bonnet. The valve body is disposed with the flushing outlet port, the inlet port and the self-cleaning outlet port. The moving valve disc is disposed with an inlet hole. The static valve disc is disposed with a self-cleaning outlet hole and a flushing outlet hole. The bonnet is fixedly connected to the valve body. The moving valve disc is movably coupled to the inner of the bonnet. The static valve disc is fixedly connected to the inner of the valve body. The inlet hole of the moving valve disc is connected to the inlet port of the valve body. The self-cleaning outlet hole and the flushing outlet hole of the static valve disc are respectively connected to the self-cleaning outlet port and the flushing outlet port of the valve body. A portion of the rotating handle is running through the bonnet and is coaxially connected to the moving valve disc. The rotating handle rotates to drive the moving valve disc to rub against the static valve disc, so that the inlet hole of the moving valve disc is switched to connect to the self-cleaning outlet hole and the flushing outlet hole of the static valve disc, or is switched to separate from the self-cleaning outlet hole and the flushing outlet hole of static valve disc.

In another exemplary embodiment, the manual control valve includes a rotating handle, a moving valve disc, a static valve disc, a valve body, a bonnet, a valve sleeve with the side thereof disposed with an inlet waterway and a valve rod. The valve body is disposed with a flushing outlet port, an inlet port and a self-cleaning outlet port. The moving valve disc and the static valve disc are respectively annular structures. The moving valve disc is disposed with an inlet channel. The static valve disc is disposed with a self-cleaning outlet channel and a flushing outlet hole. The bonnet is fixedly connected to the valve body. The valve sleeve is sleeved on the inner of the valve body. A portion of the rotating handle runs through the bonnet and is coaxially connected to the valve sleeve. The moving valve disc and the static valve disc are respectively disposed in the valve body, and are sleeved on the valve sleeve. The moving valve disc is coaxially linked to the valve sleeve. The inlet channel of the moving disc is connected to the inlet port of the valve body. The self-cleaning outlet channel of the static valve disc is connected to the inlet passage of the valve sleeve. The flushing outlet hole of the static valve disc is connected to the flushing outlet port of the valve body. The moving valve disc rubs against the static valve disc. The inlet channel of the moving valve disc, when the moving valve disc rotates, is switched to connect to the self-cleaning outlet channel of the moving valve disc and the flushing outlet hole, or is switched to separate from the self-cleaning outlet channel and the flushing outlet hole of the moving valve disc. The valve rod is sleeved on the inner of the valve sleeve. The rotating handle is disposed with two ends running throughout. A push switch mechanism is disposed between the inner of the rotating handle and the inner of the valve sleeve. The push switch mechanism is coaxially connected to the valve rod, so as to drive the valve rod to move in the axial direction to close or open the inlet passage of the valve sleeve and the self-cleaning outlet port of the valve body.

In another exemplary embodiment, the manual control valve further comprises a gear switch element. The gear switch element is disposed with a plurality of concave portions along the circumference. The concave portions form the outlet gear of the self-cleaning outlet hole of the static valve disc, the outlet gear of the flushing outlet hole and the close gear. The gear switch element is coaxially fixedly connected to the rotating handle. The outer end face of the bonnet is disposed with a spring pin. The spring pin is faced to the concave portions of the gear switch element. The rotating handle rotates to drive the gear switch element to rotate, so that the spring pin of the bonnet is switched to insert to each concave portion of the gear switch element.

In another exemplary embodiment, the push switch mechanism includes a button, a spring, a push body, a rotation body and a push rod. The inner wall of the rotating handle is disposed with a plurality of spaced axial ribs along the circumference. The periphery of the side of the push body is disposed with a plurality of spaced axial first slide grooves. One end of the push body is disposed with a plurality of saw teeth in the circumference. The periphery of the side of the rotation body is disposed with a plurality of spaced axial second slide grooves. One end of the rotation body is disposed with a plurality of ratchets in the circumference. The push body and the rotation body are coaxially sleeved in the rotating handle. The saw teeth of the push body are engaged to the ratchets of the rotation body. The axial ribs of the rotating handle are respectively coupled to the first slide grooves of the push body in sliding way. One end of the push rod is fixedly connected to the other end of the rotation body. The other end of the push rod is coaxially connected to the valve pole. The spring is sleeved on the push rod and abuts against between the other end of the rotation body and the valve sleeve. The button is fixedly connected to the other end of the push body, and a portion of the button extends out of the rotating handle. The button is pressed to push the push body to move in the axial direction, so that the axial ribs of the rotating handle respectively fall to the second slide grooves of the rotation body or respectively abut against the ratchets.

In another exemplary embodiment, the device includes two flushing spray nozzles that are respectively for hip cleaning and female private parts cleaning. Two flushing outlet ports of the valve body are respectively connected to the two flushing spray nozzles. Two flushing outlet holes of the static valve disc are respectively connected to the two flushing outlet ports of the valve body, and two self-cleaning outlet holes of static valve disc are respectively connected to self-cleaning outlet ports of the valve body. The moving valve disc rotates to make the inlet hole switch to connect to the self-cleaning outlet holes and the flushing outlet holes of the static valve disc, or switched to separate from the self-cleaning outlet holes and the flushing outlet holes of the static valve disc. The gear switch element is disposed with five concave portions that respectively formed outlet gears of the two self-cleaning outlet holes of the static valve disc, outlet gears of the two flushing outlet holes and a close gear. The close gear is disposed between the two opposite inner sides of the two outlet gears of the two self-cleaning outlet holes. Two outlet gears of the two flushing outlet holes are respectively disposed at the opposite outer sides of the two outlet gears of the two self-cleaning outlet holes.

In another exemplary embodiment, the device includes two flushing spray nozzles that are respectively for hip cleaning and female private parts cleaning, two flushing outlet ports of the valve body that are respectively connected to the two flushing spray nozzles, and two flushing outlet holes of the static valve disc that are respectively connected to the two flushing outlet ports of the valve body. The moving valve disc rotates to make the inlet channels switched to connect to the two flushing outlet holes and the self-cleaning outlet channels of the static valve disc, or switched to separate from the two flushing outlet holes and the self-cleaning outlet channels of the static valve disc.

In another exemplary embodiment, the inlet channel of the moving valve disc is disposed at the back side and is running through the outer side of the moving valve disc. The self-cleaning outlet channel of the static valve disc is disposed at the front side and is running through the inner side of the static valve disc. In another exemplary embodiment, the valve rod is disposed with an outlet passage. The entrance of the outlet passage is disposed at a side of the valve rod. The exit is disposed at one end of the valve rod and is connected to the self-cleaning outlet port of the valve body. The valve rod moves coaxially to make the outlet passage connected to the inlet passage of the valve sleeve or separated from the inlet passage of the valve sleeve.

In another exemplary embodiment, two self-cleaning outlet holes of the static valve disc are connected to each other at the back side of the static valve disc. In another exemplary embodiment, the inlet of the self-cleaning pole is disposed at one end, and the flushing hole of the self-cleaning pole is disposed at the side. In another preferred embodiment, the self-cleaning pole is fixedly connected to a flushing toilet cover base with a flushing spray nozzle and is crossed above the flushing spray nozzle, the flushing hole of the self-cleaning pole is faced to flushing spray nozzle at the lower.

The controllable self-cleaning device for a flushing spray nozzle has the following advantages:

1. With the self-cleaning pole and the manual control valve, the self-cleaning pole is disposed with an inlet and a flushing hole to clean the flushing spray nozzle. The inlet is connected to the flushing hole. The manual control valve is disposed with an inlet port connected to the water source and a self-cleaning outlet port. The self-cleaning outlet port of the manual control valve is connected to the inlet of the self-cleaning pole, so that the outflow of the flushing hole of the self-cleaning pole by the manual control valve is manually controllable. A user can control the clean time of the self-cleaning pole manually, thus ensuring the clean effect. For a single cool cover, the self-cleaning pole may clean the flushing spray nozzle, which has a stronger flushing power compared to that applied with the spray pole, so that it enhances cleaning the flushing spray nozzle.

2. As the manual control valve is further disposed with a flushing outlet port to connect to the inlet port of the flushing spray nozzle, the flushing outlet port of the manual control valve and the self-cleaning outlet port are switched to outflow water, so that the controllable self-cleaning device can drain out the dirt water that, due to the long time of not being used, the inner water is gone off, by prolonging the cleaning time of the self-cleaning flushing spray nozzle, it avoids dirt water directly flushing the human body. On the other hand, for the single cool cover that is externally connected to a warm water device, the controllable self-cleaning device can prolong the cleaning time of the self-cleaning spray nozzle, so that the hip cleaning or female private parts cleaning function works after the cool water inside the single cool cover is drained out, thus avoiding cool water directly flushing to the human skin.

3. With the gear switch element and the bonnet with spring pin, the gear switch element is disposed with five concave portions that respectively formed outlet gears of the two self-cleaning outlet holes of the static valve disc, outlet gears of the two flushing outlet holes and a close gear. The close gear is disposed between the two opposite inner sides of the two outlet gears of the two self-cleaning outlet holes. Two outlet gears of the two flushing outlet holes are respectively disposed at the opposite outer sides of the two outlet gears of the two self-cleaning outlet holes, so that it ensures that when using the flushing spray nozzle each time, the self-cleaning process performs firstly even if a user forgets to start up the self-cleaning process.

The present application will be further described with the drawings and the embodiment, but one should know that, the scope of the present application is not limited to the embodiments.

BRIEF DESCRIPTION OF THE DRAWINGS

The exemplary embodiment will now be described in detail with reference to the following figures, in which.

DETAILED DESCRIPTION

Figure 1:
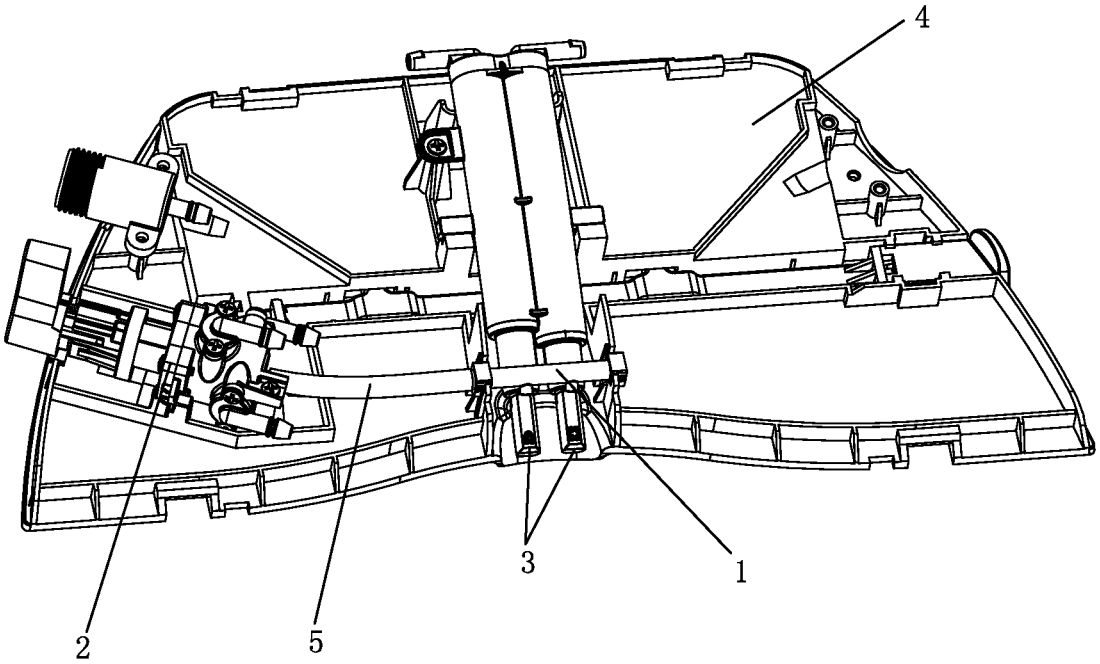
FIG. 1 illustrates a schematic diagram of a first exemplary embodiment that includes a flushing toilet cover base, a flushing spray nozzle.
Figure 2:
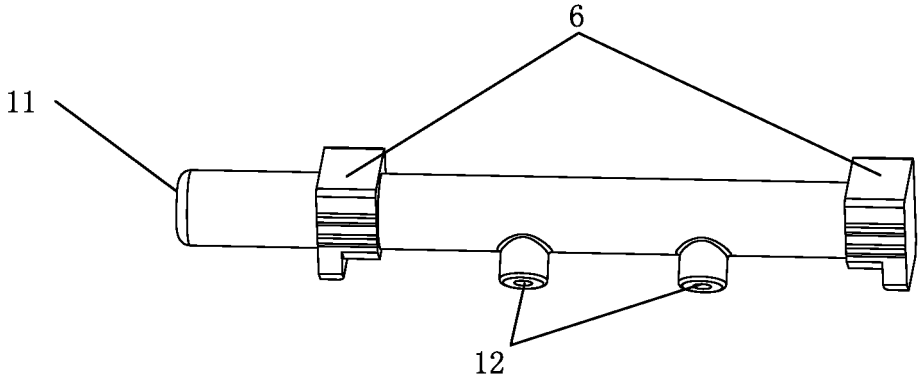
FIG. 2 illustrates a schematic diagram of a self-cleaning pole of the first exemplary embodiment.
Figure 3:
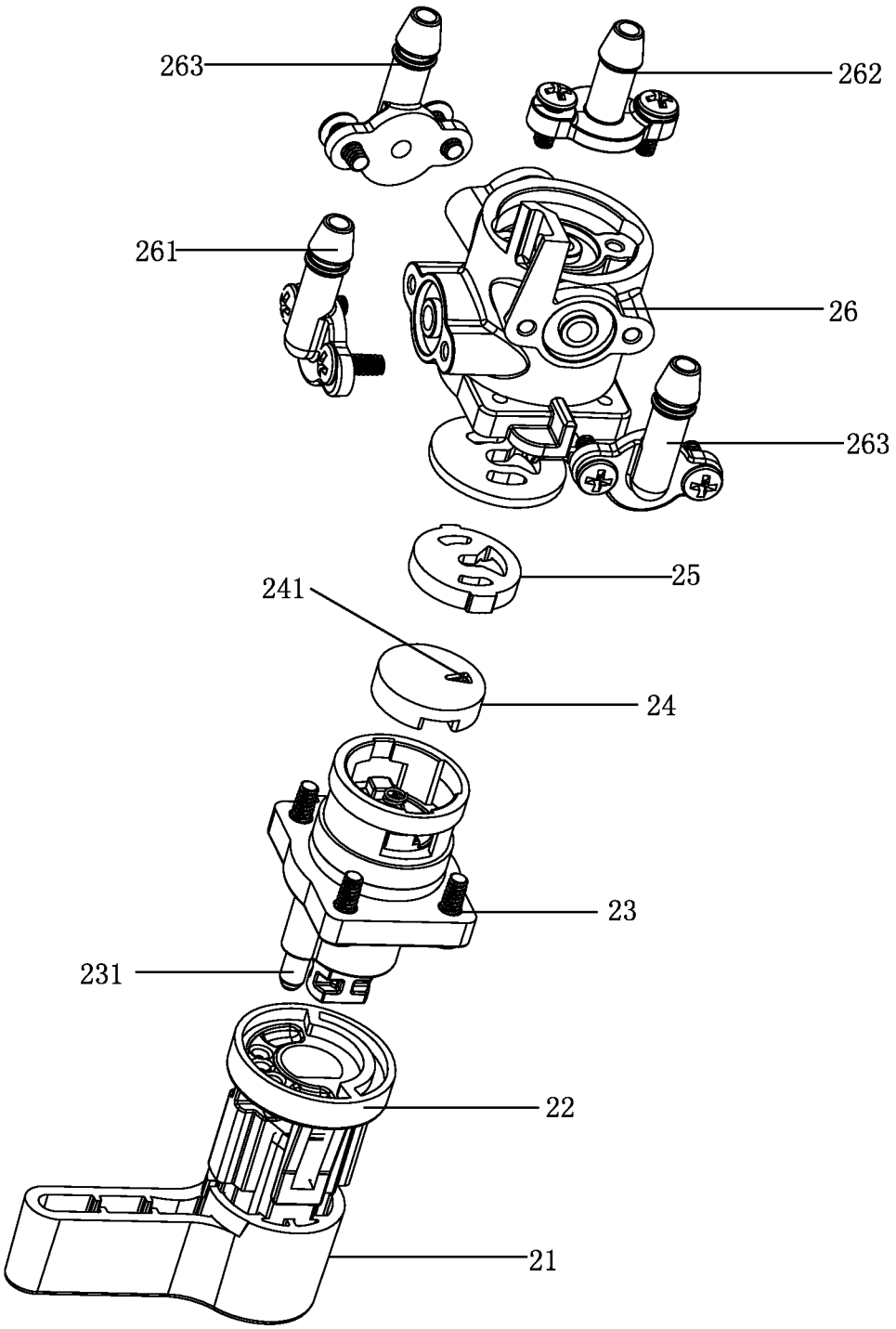
FIG. 3 illustrates an exploded and schematic diagram of a manual control valve of the first exemplary embodiment.
Figure 4:
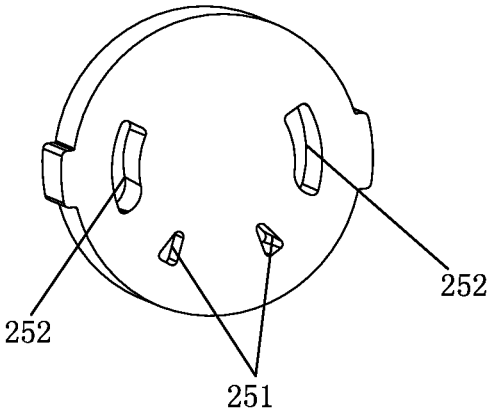
FIG. 4 illustrates a front view of a static valve disc of the first exemplary embodiment.

Referring to FIGS. 1-6 that show the first exemplary embodiment, a controllable self-cleaning device for a flushing spray nozzle of the present invention comprises a self-cleaning pole 1 and a manual control valve 2. The self-cleaning pole 1 is disposed with an inlet 11 and flushing holes 12 to clean the flushing spray nozzle 3. The inlet 11 is disposed at one end of the self-cleaning pole. The flushing holes 12 are disposed at one side of the self-cleaning pole 1. The inlet 11 is connected to the flushing hole by the inner passage of the self-cleaning pole 1. The manual control valve 2 is disposed with an inlet port 261 to connect to the water source and a self-cleaning outlet port 262. The self-cleaning outlet port 262 of the manual control valve 2 is connected to the inlet 11 of the self-cleaning pole 1 by flexible pipe 5.

The manual control valve 2 may further comprise a flushing outlet port 263. The flushing outlet port 263 is connected to the inlet port 261 of the flushing spray nozzle 3. The flushing outlet port 263 of the manual control valve 2 and the self-cleaning outlet port 262 are switched to outflow water.

The manual control valve 2 may comprises a rotating handle 21, a moving valve disc 24, a static valve disc 25, a valve body 26 and a bonnet 23. The valve body 26 is disposed with the flushing outlet port 263, the inlet port 261 and the self-cleaning outlet port 262. The moving valve disc 24 is disposed with an inlet hole 241. The static valve disc 25 is disposed with a self-cleaning outlet hole 251 and a flushing outlet hole 252. The bonnet 23 is fixedly connected to the valve body 26. The moving valve disc 24 is movably coupled to the inner of the bonnet 26. The static valve disc 25 is fixedly connected to the inner of the valve body 26. The inlet hole 241 of the moving valve disc 24 is connected to the inlet port 261 of the valve body 26. The self-cleaning outlet hole 251 and the flushing outlet hole 252 of the static valve disc 25 are respectively connected to the self-cleaning outlet port 262 and the flushing outlet port 263 of the valve body 26. A portion of the rotating handle 21 is running through the bonnet 23 and is coaxially connected to the moving valve disc 25. The rotating handle 21 rotates to drive the moving valve disc 24 to rub against the static valve disc 25, so that the inlet hole 241 of the moving valve disc 24 is switched to connect to the self-cleaning outlet hole 251 and the flushing outlet hole 252 of the moving valve disc 24 or is switched to separate from the self-cleaning outlet hole 251 and the flushing outlet hole 252 of moving valve disc 24.

The manual control valve 2 further comprises a gear switch element 22. The gear switch element 22 is disposed with a plurality of concave portions along the circumference. The concave portions form the outlet gear of the self-cleaning outlet hole of the static valve disc 25, the outlet gear of the flushing outlet hole and the close gear. The gear switch element 22 is coaxially fixedly connected to the rotating handle 21. The outer end face of the bonnet 23 is disposed with a spring pin 231. The spring pin 231 is faced to the concave portions of the gear switch element. The rotating handle 21 rotates to drive the gear switch element 22 to rotate, so that the spring pin 231 of the bonnet 23 is switched to insert to each concave portion of the gear switch element 22.

Figure 5:
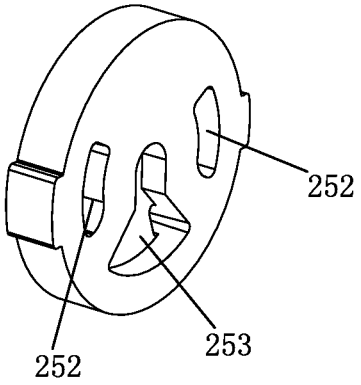
FIG. 5 illustrates a back view of the static valve disc of the first exemplary embodiment.
Figure 6:
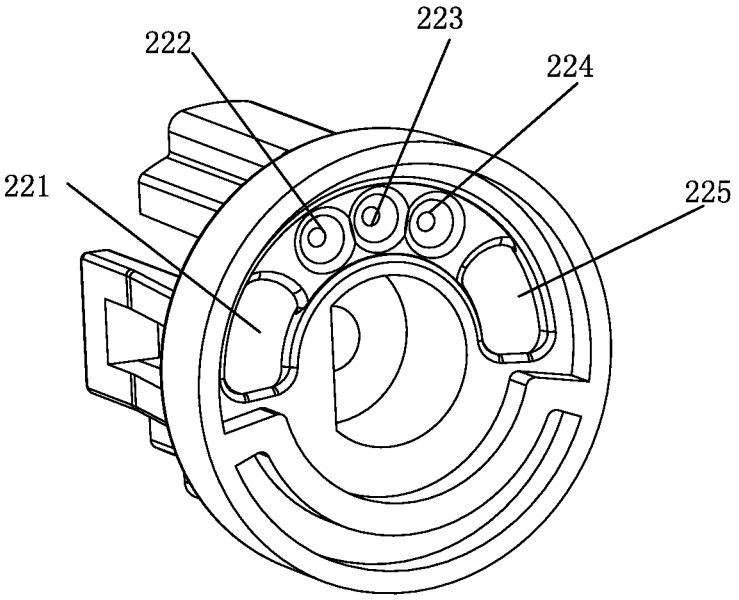
FIG. 6 illustrates a schematic diagram of a gear switch element of the first exemplary embodiment.
Figure 7:
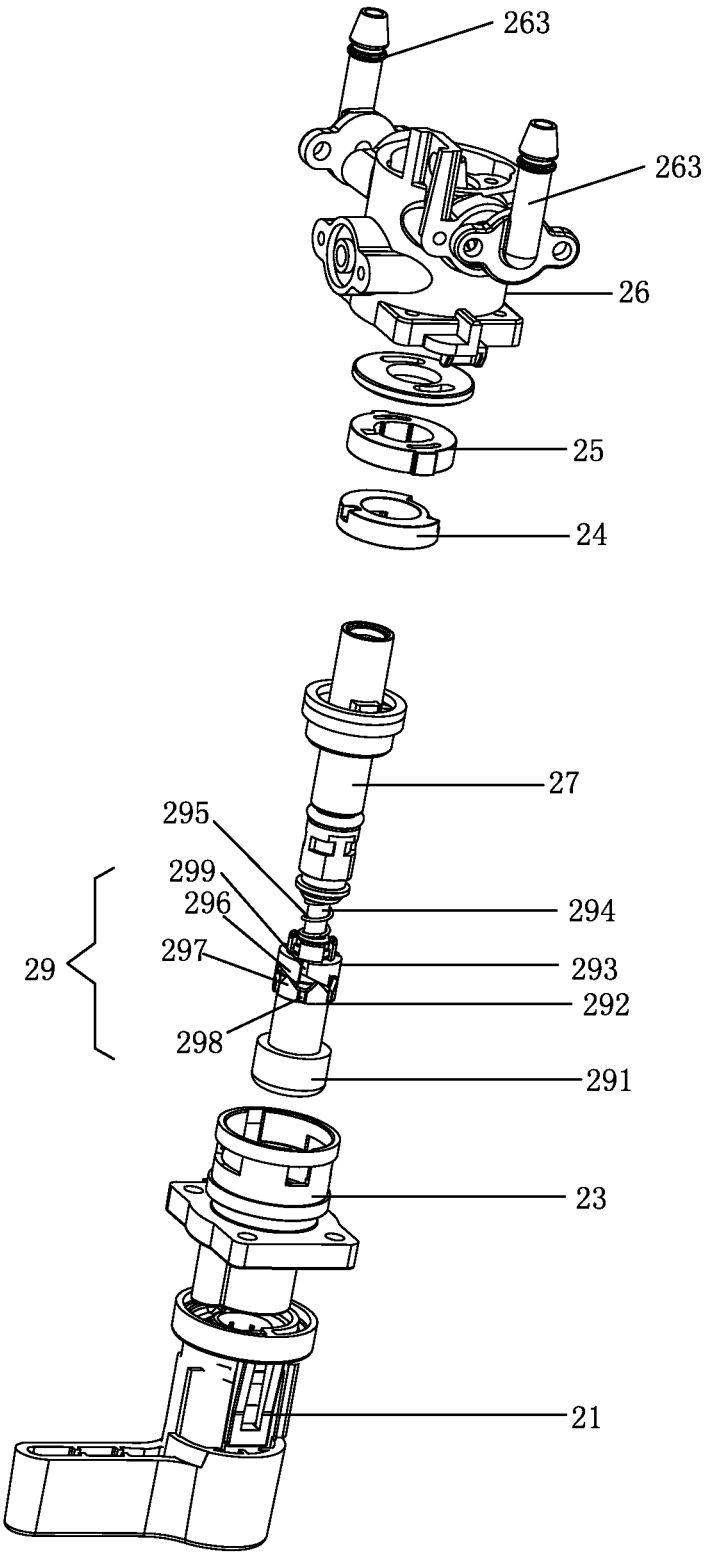
FIG. 7 illustrates an exploded and schematic diagram of a second exemplary embodiment.
Figure 8:
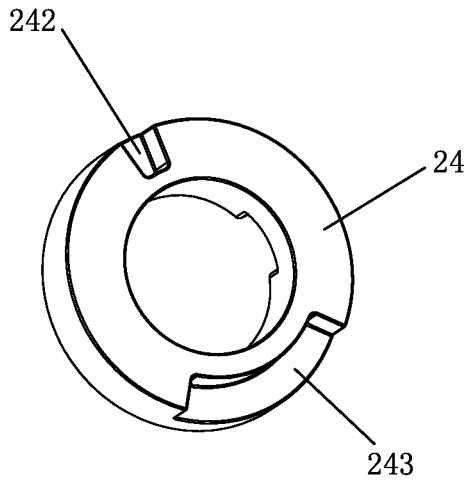
FIG. 8 illustrates a back view of a moving valve disc of the second exemplary embodiment.
Figure 9:
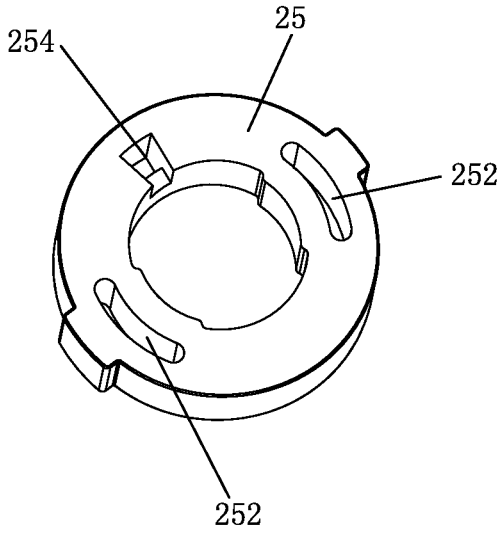
FIG. 9 illustrates a front view of a static valve disc of the second exemplary embodiment.

The exemplary embodiment comprises two flushing spray nozzles 3 that are respectively for hip cleaning and female private parts cleaning. Two flushing outlet ports 263 of the valve body 26 are respectively connected to the two flushing spray nozzles 3. Two flushing outlet holes 252 of the static valve disc 25 are respectively connected to the two flushing outlet ports 263 of the valve body 26, and two self-cleaning outlet holes 251 of static valve disc 25 are respectively connected to self-cleaning outlet ports 262 of the valve body 26. In detailed, as shown in FIG. 5, two self-cleaning outlet holes 251 of the static valve disc 25 are connected at the rear side. That is to say, the rear side of the static valve disc 25 is disposed with a connecting hole 253 of the two self-cleaning outlet holes 251. The connecting hole is connected to the self-cleaning outlet ports 262 of the valve body. The moving valve disc 24 rotates to make the inlet hole 241 switched to connect to the self-cleaning outlet holes 251, the flushing outlet holes 252 of the static valve disc 25, or switched to separate from the self-cleaning outlet holes 251, and the flushing outlet holes 252 of the static valve disc 25. The gear switch element 22 is disposed with five concave portions that respectively formed outlet gears of the two self-cleaning outlet holes 251 of the static valve disc 25, outlet gears of the two flushing outlet holes 252 and a close gear. The close gear is disposed between the two opposite inner sides of the two outlet gears of the two self-cleaning outlet holes 251. Two outlet gears of the two flushing outlet holes 252 are respectively disposed at the opposite outer sides of the two outlet gears of the two self-cleaning outlet holes 251. In these five concave portions, the central three concave portions are holes, the rest two are grooves. Herein, to distinguish these concave portions, they are named: female private parts cleaning gear groove 221, left self-cleaning gear hole 222, close gear hole 223, right self-cleaning gear hole 224, hip cleaning gear groove 225.

The manual control valve 2 and the self-cleaning pole 1 are respectively assembled to the flushing toilet cover base 4. In detail, both ends of the self-cleaning pole 1 are respectively disposed with a lock stick 6. The self-cleaning pole 1 is locked to the flushing toilet cover base 4 by the two lock sticks 6, and is laid across the two flushing spray nozzles 3. Two flushing holes 12 of the self-cleaning pole are respectively faced to the flushing spray nozzles 3 at the lower.

The controllable self-cleaning device for a flushing spray nozzle is provided such that in the initial state, the waterways are closed. The spring pin 231 of the bonnet 23 is inserted to the central concave portion of the gear switch element, the close gear hole 223. When rotating the rotating handle 21 in a certain angle in a direction, the gear switch element 22 rotates, and spring pin 231 of the bonnet 23 inserts to the left self-cleaning gear hole 222 or the right self-cleaning gear hole 224. At the same time, the moving valve disc 24 rotates, the inlet hole 241 is connected to one self-cleaning outlet hole 251 of the static valve disc 25, so that the self-cleaning waterway of the manual control valve 2 is open. Water enters the self-cleaning pole 1 and sprays out of the two flushing holes 12 of the self-cleaning pole 1 so as to flush the two flushing spray nozzles 3. When continuing rotating the rotating handle 21 in a certain angle in the same direction, the gear switch element rotates, the spring pin 231 of the bonnet 23 inserts to the hip cleaning gear groove 225 or the female private parts cleaning gear groove 221. At the same time, the moving valve disc 24 rotates as well. The inlet hole 241 is connected to one flushing outlet hole 252 of the static valve disc 25, so that the flushing waterway of the manual control valve 2 is open. Water sprays out of the flushing spray nozzle 3 of hip cleaning function or the flushing spray nozzle 3 of female private parts cleaning function. To close the manual control valve 2, it only needs to rotate the rotating handle 21 reversely. The gear switch element and the moving valve disc 24 rotate respectively to the close direction. During the process, the spring pin 231 of the bonnet 23 returns to one self-cleaning gear hole, then returns to the close gear hole. Therefore, during the hip cleaning or female private parts cleaning, the self-cleaning pole 1 has to flush twice to the two flushing spray nozzles 3 so that it guarantees the clean of the two flushing spray nozzles 3.

Referring to FIGS. 7-11 that show the second embodiment, the controllable self-cleaning device for a flushing spray nozzle is provided such that the manual control valve 2 comprises a rotating handle 21, a moving valve disc 24, a static valve disc 25, a valve body 26, a bonnet 23, a valve sleeve 27 with the side thereof disposed with an inlet waterway 271 and a valve rod 28. The valve body 26 is disposed with a flushing outlet port 263, an inlet port 261 and a self-cleaning outlet port 262. The moving valve disc 24 and the static valve disc 25 are respectively annular structures. The moving valve disc 24 is disposed with an inlet channel. The static valve disc 25 is disposed with a self-cleaning outlet channel 254 and a flushing outlet hole 252. The bonnet 23 is fixedly connected to the valve body 26. The valve sleeve 27 is sleeved on the inner of the valve body 26. A portion of the rotating handle 21 runs through the bonnet 23 and is coaxially connected to the valve sleeve 27. The moving valve disc 24 and the static valve disc 25 are respectively disposed in the valve body 26, and are sleeved on the valve sleeve 27. The moving valve disc 24 is coaxially linked to the valve sleeve 27. The inlet channel of the moving disc 24 is connected to the inlet port 261 of the valve body 26. The self-cleaning outlet channel 254 of the static valve disc 25 is connected to the inlet passage 271 of the valve sleeve 27. The flushing outlet hole 252 of the static valve disc 25 is connected to the flushing outlet port 263 of the valve body 26. The moving valve disc 24 rubs against the static valve disc 25. The inlet channel of the moving valve disc 24, when the moving valve disc 24 rotates, is switched to connect to the self-cleaning outlet channel 254 of the moving valve disc 24 and the flushing outlet hole 252, or is switched to separate from the self-cleaning outlet channel 254 and the flushing outlet hole 252 of the moving valve disc 24. The valve rod 28 is sleeved on the inner of the valve sleeve 27. The rotating handle 21 is disposed with two ends running throughout. A push switch mechanism 29 is disposed between the inner of the rotating handle 21 and the inner of the valve sleeve 27. The push switch mechanism 29 is coaxially connected to the valve rod 28, so as to drive the valve rod 28 to move in axial direction to close or open the inlet passage 271 of the valve sleeve 27 and the self-cleaning outlet port 262 of the valve body 26.

The push switch mechanism 29 comprises a button 291, a spring 295, a push body 292, a rotation body 293 and a push rod 294. The inner wall of the rotating handle 21 is disposed with a plurality of spaced axial ribs along the circumference (not shown), the periphery of the side of the push body 292 is disposed with a plurality of spaced axial first slide grooves 298. One end of the push body 292 is disposed with a plurality of saw teeth 297 in the circumference. The periphery of the side of the rotation body 293 is disposed with a plurality of spaced axial second slide grooves 299. One end of the rotation body 293 is disposed with a plurality of ratchets 296 in the circumference. The push body 292 and the rotation body 293 are coaxially sleeved in the rotating handle 21. The saw teeth 297 of the push body 292 are engaged to the ratchets 296 of the rotation body 293. The axial ribs of the rotating handle 21 are respectively coupled to the first slide grooves 298 of the push body 292 in a sliding way. One end of the push rod 294 is fixedly connected to the other end of the rotation body 293. The other end of the push rod 294 is coaxially connected to the valve pole 28. The spring 295 is sleeved on the push rod 294 and abuts against between the other end of the rotation body 293 and the valve sleeve 27. The button 291 is fixedly connected to the other end of the push body 292. A portion of the button 291 extends out of the rotating handle 21. The button 291 is pressed to push the push body 292 to move in an axial direction, so that the axial ribs of the rotating handle 21 respectively fall to the second slide grooves 299 of the rotation body 293 or respectively abut against the ratchets 296.

The controllable self-cleaning device for a flushing spray nozzle comprises two flushing spray nozzles 3 that are respectively for hip cleaning and female private parts cleaning. Two flushing outlet ports 263 of the valve body 26 are respectively connected to the two flushing spray nozzles 3. Two flushing outlet holes 252 of the static valve disc 25 are respectively connected to the two flushing outlet ports 263 of the valve body 26. The moving valve disc 24 rotates to make the inlet channels switched to connect to the two flushing outlet holes 252 and the self-cleaning outlet channels 254 of the static valve disc 25, or switched to separate from the two flushing outlet holes 252 and the self-cleaning outlet channels 254 of the static valve disc 25.

Figure 10:
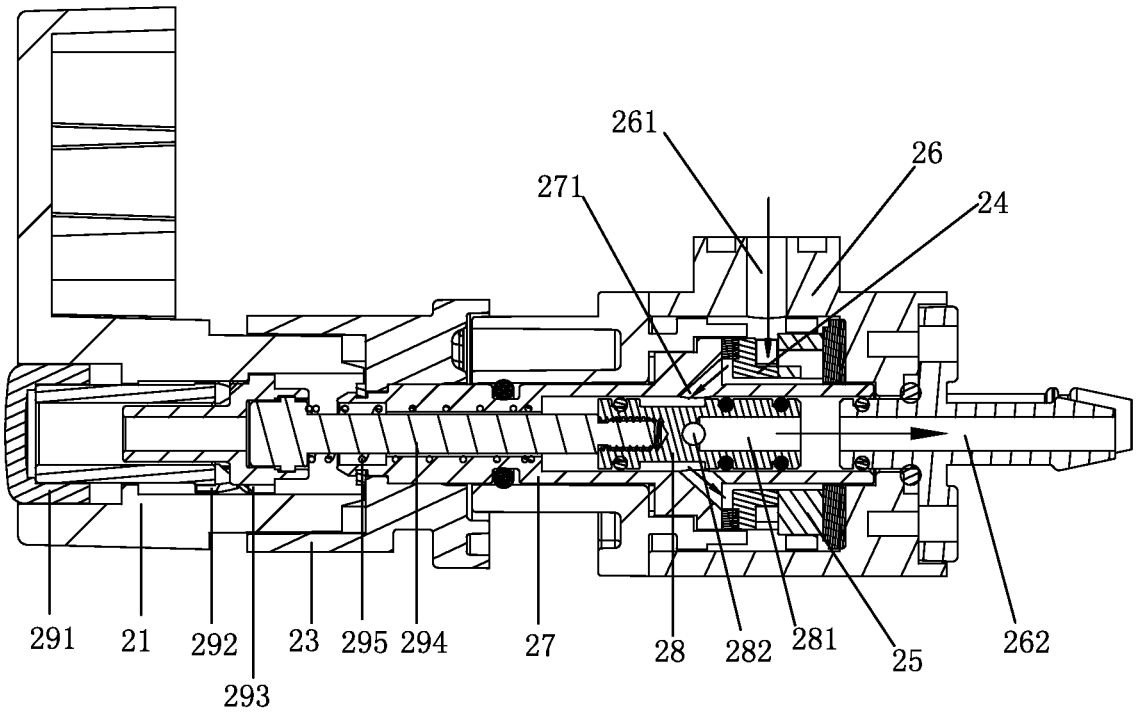
FIG. 10 illustrates a sectional diagram of the second exemplary embodiment when water flows out of the self-cleaning outlet port of the valve body.
Figure 11:
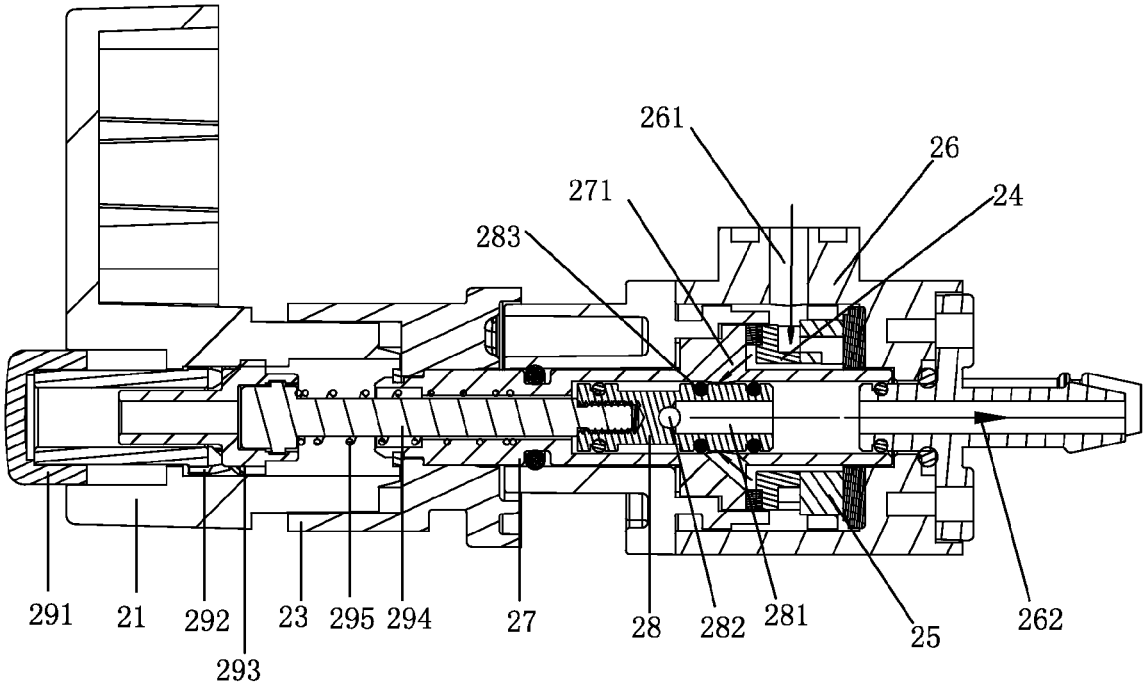
FIG. 11 illustrates a sectional diagram of the second exemplary embodiment when no water flows out of the self-cleaning outlet port of the valve body.

The valve rod 28 is disposed with an outlet passage 281. The entrance 282 of the outlet passage 281 is disposed at a side of the valve rod 28. The exit is disposed at one end of the valve rod 28 and is connected to the self-cleaning outlet port 262 of the valve body 26. The valve rod 28 moves coaxially to make the outlet passage 281 connected to the inlet passage 271 of the valve sleeve 27 or separated from the inlet passage 271 of the valve sleeve 27. In detailed, two sealing rings 283 are sleeved on the outer of the valve rod 28, when the valve rod 28 moves coaxially deviating from the direction of the rotating handle 21. Two sealing rings 283 are far away from the inlet passage 271 of the valve sleeve 27, so that the outlet passage 281 of the valve rod 28 is connected to the inlet passage 271 of the valve sleeve 27, as shown in FIG. 10. When the valve rod 28 moves coaxially towards the rotating handle 21, two sealing rings 283 close the inlet passage 271 of the valve sleeve 27, so that the outlet passage of the valve rod 28 is separated from the inlet passage 271 of the valve sleeve 27, as shown in FIG. 11.

The inlet channel of the moving valve disc 24 is disposed at the back side and is running through the outer side of the moving valve disc 24. The self-cleaning outlet channel 254 of the static valve disc 25 is disposed at the front side and is running through the inner side of the static valve disc 25. In detail, there are two inlet channels of the moving valve disc 25. One inlet channel 242 is used to connect to the self-cleaning outlet channel 254 of the static valve disc 25. The other one is switched to connect the two flushing outlet holes 252 of the static valve disc 25.

The controllable self-cleaning device for a flushing spray nozzle is provided such that when one inlet channel 242 of the moving valve disc 24 is connected to the self-cleaning outlet channel 254 of the static valve disc 25, pressing the button 291 pushes the push body 292 to move coaxially. The saw teeth 297 of the push body 292 respectively push the corresponding ratchets 296 of the rotation body 293, so that the rotation body 293 rotates and pushes the valve rod 28 to move coaxially by the push rod 294. At the same time, the spring 295 is compressed. After the rotation body 293 is rotated, the coaxial ribs on the inner wall of the rotating handle 21 abut against the ratchets 296 of the rotation body 293 prevent them from being slidingly sleeved on the second slide grooves 299 of the rotation body 293, so that the rotation body 293 is locked still. The valve rod 28 remains in this condition after coaxially moving. At this time, the outlet channel 281 of the valve rod 28 is connected to the inlet channel 271 of the valve sleeve 27. The self-cleaning outlet port 262 of the valve body 26 outflows water. Water enters the self-cleaning pole 1 and sprays out of the two flushing holes of the self-cleaning pole 1, thus flushing the two flushing spray nozzles 3.

When pressing the button 291 again, the button 291 pushes the push body to move coaxially again, the sawteeth 297 of the push body 292 respectively push the corresponding ratchets 296 of the rotation body 293, so that the rotation body 293 rotates. The force of the spring 295 causes the coaxial ribs on the inner wall of the rotating handle 21 to slide and sleeve on the second slide grooves 299 of the rotation body 293 prevent them from abutting against the ratchets 296 of the rotation body 293, so that the push body 294 drives the valve rod 28 to reposition. At final, the outlet channel 281 of the valve rod 28 is separated from the inlet channel of the valve sleeve 27, the self-cleaning outlet port 262 of the valve body 26 stops outflowing water, the self-cleaning pole 1 stops flushing.

When the self-cleaning outlet port 262 of the valve body 26 is open, to realize hip cleaning or female private parts cleaning function, it only needs to rotate the rotating handle 21, so that the rotating handle 21 drives the moving valve disc 24 to rotate by the valve sleeve 27. When the other inlet channel 243 of the moving valve disc 24 is connected to one flushing outlet hole 252 of the static valve disc, one flushing outlet port 263 of the valve body 26 outflows water. Water enters one flushing spray nozzle 3 to realize hip cleaning or female private parts cleaning. After the moving valve disc rotates, one inlet channel 242 of the moving valve disc is separated from the self-cleaning outlet channel 254 of the static valve disc 25. The self outlet channel of the valve body 26 stops outflowing. If neither self-cleaning and hip cleaning nor female private parts cleaning are needed, it only needs to rotate the rotating handle 21 to make the inlet channels of the moving valve disc 24 separated from the self-cleaning outlet channel 254, and two flushing outlet holes 252 of the static valve disc 25.

The controllable self-cleaning device for a flushing spray nozzle is provided to control the self-cleaning time manually with the self-cleaning pole and the manual control valve, thus benefitting the cleaning effect.

Although the present application has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A controllable self-cleaning device for cleaning a flushing spray nozzle that selectively washes private parts, comprising:

a flushing spray nozzle including nozzle outlet openings that direct water to wash private parts, a self-cleaning pole, wherein the self-cleaning pole includes a water inlet, a flushing outlet hole, wherein the water inlet is connected to the flushing outlet hole, wherein the self-cleaning pole extends transversely across and above the flushing spray nozzle and the flushing outlet hole is in direct facing relation with the nozzle outlet openings, a manual control valve, wherein the manual control valve includes a valve inlet port configured to connect to a water source, a self-cleaning outlet port, wherein the self-cleaning outlet port is connected to the water inlet of the self-cleaning pole, wherein the manual control valve is manually operable to cause water to be delivered from the self-cleaning outlet port to the water inlet of the self-cleaning pole, wherein water is caused to spray downward from the flushing outlet hole and directly onto the nozzle outlet openings to clean the flushing spray nozzle.

2. The controllable self-cleaning device for a flushing spray nozzle according to claim 1, wherein the manual control valve further comprises a flushing outlet port, wherein the flushing spray nozzle includes a nozzle inlet port, and wherein the flushing outlet port is connected to the nozzle inlet port of the flushing spray nozzle, wherein the flushing outlet port of the manual control valve and the self-cleaning outlet port are manually selectively switched to outflow water from the valve.

3. The controllable self-cleaning device for a flushing spray nozzle according to claim 2, wherein the manual control valve comprises a rotatable handle, a movable valve disc, a static valve disc, a valve body and a bonnet, wherein the flushing outlet port, the inlet port and the self-cleaning outlet port are disposed on the valve body, wherein the movable valve disc is disposed with an inlet hole, the static valve disc is disposed with a self-cleaning outlet hole and a flushing outlet hole;

wherein the bonnet is fixedly connected to the valve body, wherein the movable valve disc is movably coupled inside of the bonnet, wherein the static valve disc is fixedly connected to the inside of the valve body, wherein the inlet hole of the movable valve disc is connected to the inlet port of the valve body, wherein the self-cleaning outlet hole and the flushing outlet hole of the static valve disc are respectively connected to the self-cleaning outlet port and the flushing outlet port of the valve body, wherein the rotatable handle includes a portion, wherein the portion of the rotating handle extends through the bonnet and is coaxially connected to the movable valve disc, wherein rotation of the rotatable handle rotates the movable valve disc in rubbing relation against the static valve disc, so that the inlet hole of the moving valve disc is switched to either connect to the self-cleaning outlet hole and the flushing outlet hole of the static valve disc, or separate from the self-cleaning outlet hole and the flushing outlet hole of the static valve disc.

4. The controllable self-cleaning device for a flushing spray nozzle according to claim 2, wherein the manual control valve comprises a rotatable handle, a movable valve disc, a static valve disc, a valve body, a bonnet, a valve sleeve wherein a side of the valve sleeve includes an inlet passage, and a valve rod, wherein the flushing outlet port, the inlet port and the self-cleaning outlet port are disposed on the valve body, wherein the movable valve disc and the static valve disc are respectively annular structures, wherein the movable valve disc is disposed with an inlet channel, wherein the static valve disc is disposed with a self-cleaning outlet channel and a flushing outlet hole, wherein the bonnet is fixedly connected to the valve body, wherein the valve sleeve is sleeved inside of the valve body, wherein a portion of the rotatable handle extends through the bonnet and is coaxially connected to the valve sleeve, wherein the movable valve disc and the static valve disc are respectively disposed in the valve body, and are sleeved on the valve sleeve, wherein the movable valve disc is coaxially linked to the valve sleeve, wherein the inlet channel of the movable valve disc is connected to the inlet port of the valve body, wherein the self-cleaning outlet channel of the static valve disc is connected to the inlet passage of the valve sleeve, wherein the flushing outlet hole of the static valve disc is connected to the flushing outlet port of the valve body, wherein the movable valve disc abuts against the static valve disc, wherein the inlet channel of the movable valve disc, when the movable valve disc rotates, is switched to connect to the self-cleaning outlet channel of the movable valve disc and the flushing outlet hole, or is switched to separate from the self-cleaning outlet channel and the flushing outlet hole of the moving valve disc, wherein the valve rod is sleeved inside of the valve sleeve, wherein the rotatable handle includes an opening that extends therethrough, wherein a push switch mechanism is disposed in the handle opening and between the rotating handle and the valve sleeve, wherein the push switch mechanism is coaxially connected to the valve rod, so as to drive the valve rod to axially move to close or open the inlet passage of the valve sleeve and the self-cleaning outlet port of the valve body.

5. The controllable self-cleaning device for a flushing spray nozzle according to claim 4, wherein the valve rod is disposed with an outlet passage, wherein an entrance of the outlet passage is disposed at a side of the valve rod, wherein an exit of the outlet passage is disposed at one end of the valve rod and is connected to the self-cleaning outlet port of the valve body, wherein the valve rod moves coaxially to make the outlet passage connected to the inlet passage of the valve sleeve or separated from the inlet passage of the valve sleeve.

6. The controllable self-cleaning device for a flushing spray nozzle according to claim 4, wherein the inlet channel of the movable valve disc is disposed at the back side and extends through the outer side of the movable valve disc, wherein the self-cleaning outlet channel of the static valve disc is disposed at the front side and extends through the inner side of the static valve disc.

7. The controllable self-cleaning device for a flushing spray nozzle according to claim 4, further comprising:

two flushing spray nozzles that are respectively for hip cleaning and female private parts cleaning;

two flushing outlet ports of the valve body that are respectively connected to the two flushing spray nozzles; and two flushing outlet holes of the static valve disc that are respectively connected to the two flushing outlet ports of the valve body, wherein the movable valve disc rotates to make the inlet channels switched to connect to the two flushing outlet holes and the self-cleaning outlet channels of the static valve disc, or switched to separate from the two flushing outlet holes and the self-cleaning outlet channels of the static valve disc.

8. The controllable self-cleaning device for a flushing spray nozzle according to claim 1, wherein the water inlet of the self-cleaning pole is disposed at one pole end, and wherein the flushing outlet hole of the self-cleaning pole is disposed at a pole side.

9. A controllable, self-cleaning device for a flushing spray nozzle, comprising:

a self-cleaning pole, including a pole inlet, a flushing hole in connection with the pole inlet, wherein the flushing hole is directed to clean the flushing spray nozzle, wherein the flushing spray nozzle includes a nozzle inlet, a manual control valve, including a valve inlet port, wherein the valve inlet port is configured to connect to a clean water source, a self-cleaning port, wherein the self-cleaning port is connected to the pole inlet, a flushing outlet port, wherein the flushing outlet port is connected to the nozzle inlet, a valve body, wherein the valve body includes the valve inlet port, the self-cleaning port and the flushing outlet port, a bonnet in fixed connection with the valve body, an internal movable valve disc, including an inlet hole, wherein the inlet hole is fluidly connected to the valve inlet, wherein the movable valve disc is in movable supported connection with the bonnet, an internal static valve disc including a self-cleaning outlet hole, wherein the self-cleaning outlet hole is fluidly connected with the self-cleaning port, and a flushing outlet hole, wherein the flushing outlet hole is fluidly connected through the flushing outlet port, wherein the static valve disc is in fixed operative connection with the valve body, a rotatable portion in operative connection with the handle, wherein the rotatable portion extends through the bonnet and is coaxially connected with the movable valve disc wherein the rotatable portion is operative to rotate the movable valve disc in contacting relation with the static valve disc responsive to manual rotation of the handle, wherein the movable valve disc is movable to either connect the inlet hole to at least one of the self-cleaning outlet hole and the flushing outlet hole, separate the inlet hole from the self-cleaning outlet hole and the flushing outlet hole, a switch element, wherein the switch element is in coaxially fixed connection with the rotatable handle, and includes a plurality of circumferentially spaced concave portions, a spring pin in operatively supported connection with the bonnet, wherein the spring pin is in facing relation with the concave portions, wherein handle movement is operative to cause the switch element to rotate to positions in which the spring pin extends in respective ones of the concave portions, wherein engagement of the spring pin in respective ones of the concave portions corresponds to a plurality of relative rotational positions of the movable valve disc and the static valve disc in which in one of the respective positions the inlet hole is connected to the self-cleaning outlet hole, the inlet hole is connected to the flushing outlet hole, the inlet hole is blocked.

10. The controllable self-cleaning device for a flushing spray nozzle according to claim 9, further comprising:

two flushing spray nozzles, wherein the flushing spray nozzles are respectively for hip cleaning and female private parts cleaning;

two flushing outlet ports of the valve body, wherein the two flushing outlet ports are respectively connected to the two flushing spray nozzles;

two flushing outlet holes of the static valve disc, wherein the two flushing outlet holes are respectively connected to the two flushing outlet ports of the valve body; and two self-cleaning outlet holes of the static valve disc, wherein the two self-cleaning outlet holes are respectively connected to self-cleaning outlet ports of the valve body, wherein the movable valve disc rotates to make the inlet hole switched to connect to the self-cleaning outlet holes, to the flushing outlet holes of the static valve disc, or switched to separate from the self-cleaning outlet holes, and from the flushing outlet holes of the static valve disc, wherein the gear switch element is disposed with five concave portions that are respectively formed outlet gears of the two self-cleaning outlet holes of the static valve disc, outlet gears of the two flushing outlet holes and a close gear, wherein the close gear is disposed between the two opposite inner sides of the two outlet gears of the two self-cleaning outlet holes, wherein two outlet gears of the two flushing outlet holes are respectively disposed at the opposite outer sides of the two outlet gears of the two self-cleaning outlet holes.

11. The controllable self-cleaning device for a flushing spray nozzle according to claim 10, wherein two self-cleaning outlet holes of the static valve disc are connected to each other at the back side of the static valve disc.

12. A controllable self-cleaning device for a flushing spray nozzle, comprising a self-cleaning pole including a pole inlet, a flushing hole in connection with the pole inlet, wherein the flushing hole is directed to clean the flushing spray nozzle, wherein the flushing spray nozzle includes a nozzle inlet, a manual control valve, including a valve inlet port, wherein the valve inlet port is configured to connect to a clean water source, a self-cleaning port, wherein the self-cleaning port is connected to the pole inlet, a flushing outlet port, wherein the flushing outlet port is connected to the nozzle inlet, a manually rotatable handle, a valve body, wherein the valve body includes the valve inlet port, the self-cleaning port and the flushing outlet port, a bonnet in fixed connection with the valve body, an internal annular valve sleeve, wherein the valve sleeve includes an annular recessed inlet passage, and a valve rod, wherein the handle is rotationally coaxially connected to the valve sleeve, an internal movable annular valve disc, wherein the movable valve disc is coaxially operatively connected to the valve sleeve, wherein the annular movable valve disc includes an inlet channel, wherein the inlet channel is connected to the valve inlet port, an internal static annular valve disc, including a self-cleaning outlet channel connected to the inlet passageway of the valve sleeve, and a flushing outlet hole in connection with the flushing outlet port, wherein rotation of the movable valve disc in abutting engagement with the static valve disc is operative to cause in respective relative rotational positions of the movable valve disc and static valve disc, the inlet channel to be connected to the self-cleaning outlet channel, the inlet channel to be connected to the flushing outlet hole, and the inlet channel to be separated from each of the self-cleaning outlet channel and the flushing outlet hole, wherein the valve rod is axially movable relative to the valve sleeve, a push switch, wherein the push switch extends in the rotatable handle and is in operative connective with a valve rod, wherein the push switch is operative to cause axial movement of the valve rod to selectively open and close the inlet passage and the self-cleaning outlet port wherein the push switch includes a manually actuatable button, a spring, a push body, a rotation body, and a push rod, wherein the handle includes an inner wall with a plurality of circumferentially spaced axial ribs, wherein the push body includes a push body side including a plurality of spaced axial first slide grooves and a push body end wherein the push body end includes a plurality of circumferential saw teeth, wherein the rotation body includes a rotation body side including a plurality of spaced axial second slide grooves and a rotation body end wherein the rotation body end includes a plurality of circumferential ratchets, wherein the push body and the rotation body are coaxially relatively movable with regard to the handle and wherein the saw teeth of the push body are movably engaged with the ratchets of the rotation body, wherein the axial ribs of the handle are respectively movably coupled to the first slide grooves of the push body, wherein the push rod includes one rod end in operative connection with the rotation body and another rod end which is in operative connection with the valve rod, wherein the spring is operatively connected with the push rod and biases the rotation body and the valve sleeve into engagement, wherein the button is in operative connection with the push body and a portion of the button extends outside the rotatable handle, wherein axial displacement of the button relative to the handle is operative to axially move the push body such that the axial ribs of the rotatable handle are respectively engaged with either the second slide grooves of the rotation body or in abutting relation with the ratchets whereby the valve sleeve is selectively axially positioned to close and open the inlet passage and the self-cleaning outlet port.

* * * * *